US007606516B2

(12) United States Patent
Ueda et al.

(10) Patent No.: US 7,606,516 B2
(45) Date of Patent: Oct. 20, 2009

(54) IMAGE PRINTING APPARATUS

(75) Inventors: Tadayuki Ueda, Tokyo (JP); Hiroyuki Maruyama, Tokyo (JP); Toshihiro Motoi, Tokyo (JP); Kenji Izumiya, Tokyo (JP); Ryuji Okutomi, Tokyo (JP); Satoshi Ogata, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 81 days.

(21) Appl. No.: 12/010,154

(22) Filed: Jan. 22, 2008

(65) Prior Publication Data

US 2008/0213001 A1 Sep. 4, 2008

Related U.S. Application Data

(62) Division of application No. 11/785,868, filed on Apr. 20, 2007, now abandoned, which is a division of application No. 11/235,149, filed on Sep. 27, 2005, now Pat. No. 7,263,314.

(30) Foreign Application Priority Data

Jan. 31, 2005 (JP) ..... 2005-022508

(51) Int. Cl.
*G03G 15/20* (2006.01)

(52) U.S. Cl. ..... 399/167

(58) Field of Classification Search ..... 399/167
See application file for complete search history.

(56) References Cited

U.S. PATENT DOCUMENTS

| | | | |
|---|---|---|---|
| 6,420,807 | B1 | 7/2002 | Tsujimoto et al. |
| 6,456,808 | B1 | 9/2002 | Chen et al. |
| 6,501,930 | B2 | 12/2002 | Oku |
| 6,708,008 | B2 | 3/2004 | Hayashida et al. |

FOREIGN PATENT DOCUMENTS

| | | |
|---|---|---|
| JP | 58023040 A | 2/1983 |
| JP | 2000-162941 | 6/2000 |

*Primary Examiner*—David M Gray
*Assistant Examiner*—Bryan P Ready
(74) *Attorney, Agent, or Firm*—Finnegan, Henderson, Farabow, Garrett & Dunner, L.L.P.

(57) ABSTRACT

An image printing apparatus includes a control unit which controls a rotational speed of an image carrier; a detecting unit which detects data of the rotational speed; a storage unit which stores the rotational speeds up to n past rotation cycle of said image carrier; and a determining unit which determines whether a rotational speed difference between a latest rotational speed in a current rotation cycle and a rotational speed in n past rotation cycle before the current rotation cycle at a predetermined interval, which includes the same rotational position in respective rotation cycles and its near position, is more than a predetermined reference value, wherein said control unit controls the rotational speed of said image carrier by using the data of rotational speeds at a predetermined interval including the same rotational position in one or n past rotation cycle before the current rotation cycle, and further said control unit controls a rotational speed in a subsequent rotation cycle next to the current rotation cycle in accordance with a determination result obtained by said determining unit.

3 Claims, 7 Drawing Sheets

IMAGE PRINTING APPARATUS

This application is a Divisional of application Ser. No. 11/785,868, filed Apr. 20, 2007, now abandoned which is a Divisional of application Ser. No. 11/235,149, filed Sep. 27, 2005, now U.S. Pat. No. 7,263,314, which claims the benefit of priority to Japanese Patent Application No. 2005-022508, filed in Japan on Jan. 31, 2005, the entire disclosures of which are incorporated herein by reference.

BACKGROUND OF THE INVENTION

1. Field of the Invention

The present invention relates to an electrophotographic image printing apparatus such as a copying machine, printer, or FAX machine and, more particularly, to an image printing apparatus having a control unit which uniformly controls the rotational speed of an image carrier such as a photosensitive drum.

2. Description of the Prior Art

In an electrophotographic image printing apparatus, a toner image is formed on an image carrier comprising a rotating photosensitive drum, photosensitive belt, or the like, and the formed toner image is directly or indirectly transferred and fixed on an image recording sheet. In forming an image, an image exposure unit performs image exposure on the image carrier uniformly charged by a charging unit, thereby forming a latent image. In forming a latent image, however, when the peripheral speed of the image carrier which rotates at a uniform rotational speed varies, the formed image distorts. A tandem color image printing apparatus prints a color image on an image recording sheet by superimposing monochrome images formed by a plurality of monochrome image printing units. Essential requirements for obtaining high-quality color images are that the image carriers in the respective monochrome image printing units must rotate at the same speed without any speed unevenness.

Various control methods using various speed detecting units have been proposed for speed control on photosensitive drums. When the angular speed of a photosensitive drum is to be controlled to a constant speed in real time, a rotational speed control method of performing rotational speed control with an angular speed detecting unit using an encoder is used.

For example, for a tandem color image printing apparatus, a feedforward (repetitive) control technique is available as a technique of suppressing a reproducible variation per rotation as in the case with an image carrier such as a photosensitive drum, and a method of controlling rotation variations with respect to a control target rotational position by using rotational speed data at the same position in the cycle one cycle (rotation) before the control target rotational position and its near position has been proposed. See, for example, Japanese Unexamined Patent Publication No. 2000-162941 (patent reference 1).

In the above feedforward (repetitive) control, however, when an uncontrollable accidental variation occurs, the variation is stored as a controlled variable at the position. Even when no accidental variation occurs in the subsequent rotation cycles, a control unit acts to suppress this variation state, adversely affecting subsequent rotations.

SUMMARY OF THE INVENTION

The present invention can provide an image printing apparatus including a control unit which solves such problems and controls an image carrier to have a stable rotational speed.

According to the main aspect of the present invention, there is provided an image printing apparatus including a control unit which controls a rotational speed of an image carrier, a detecting unit which detects the rotational speed, a storage unit which stores data of the rotational speeds up to n past rotations of the image carrier, and a determining unit which determines whether a rotational speed difference between a latest rotational speed and a rotational speed in n past rotation cycle before a current rotation cycle at a predetermined interval, which includes the same position in respective rotation cycles and its near position, is more than a predetermined reference value, wherein the control unit controls the rotational speed of the image carrier by using the data of rotational speed at a predetermined interval including the same rotational position in one or n past rotation cycle before the current cycle, and further the control unit controls a rotational speed in a subsequent rotation cycle to the current rotation cycle in accordance with a determination result obtained by the determining unit.

In the image printing apparatus described in the main aspect, when the determining unit determines that the rotational speed difference is more than a predetermined reference value, (1) the average value of rotational speeds in a predetermined interval including the same rotational position in each past rotation cycle after n rotations of the image carrier is calculated, and a rotational speed in the next rotation cycle is controlled by using the average value, (2) the latest rotational speed detected by the detecting unit is neglected, and the rotational speed in the next cycle is controlled by using the rotational speed data in the past cycle n cycles before the current cycle, (3) a control computation coefficient for calculating the rotational speed of the image carrier from the rotational speed difference is changed in accordance with the rotational speed difference, or (4) a real time control unit which controls the rotational speed of the image carrier by feeding back the rotational speed of the image carrier in real time is added, and the rotational speed of the image carrier is controlled in real time by only feedback control without performing repetitive rotational speed control.

According to the image printing apparatus of the present invention, even when an accidental rotation variation occurs in repetitive rotational speed control on the rotational speed of the image carrier, the influence of the variation on subsequent rotations can be suppressed, and stable rotations of the image carrier can be ensured, thereby obtaining a high-resolution image.

The above and many other features and advantages of the present invention will become manifest to those skilled in the art upon making reference to the following detailed description and accompanying drawings in which preferred embodiments incorporating the principle of the present invention are shown by way of illustrative examples.

BRIEF DESCRIPTION OF THE DRAWINGS

Embodiments of the present invention will now be described, by way of example only, with reference to the accompanying drawings which are meant to be exemplary, not limiting, and wherein like elements are numbered alike in several Figure, in which:

FIGS. 6A and 6B are views showing rotation variations in the latest rotation cycle and a past rotation cycle, respectively, in which FIG. 6A shows the overall cycles, and FIG. 6B is an enlarged view of a part;

DETAILED DESCRIPTION OF THE PREFERRED EMBODIMENTS

Several preferred embodiments of the present invention will be described below with reference to the accompanying drawings.

An image printing apparatus using a rotational speed control method according to the present invention will be described first with reference to the sectional arrangement shown in FIG. 1.

Figure 1:
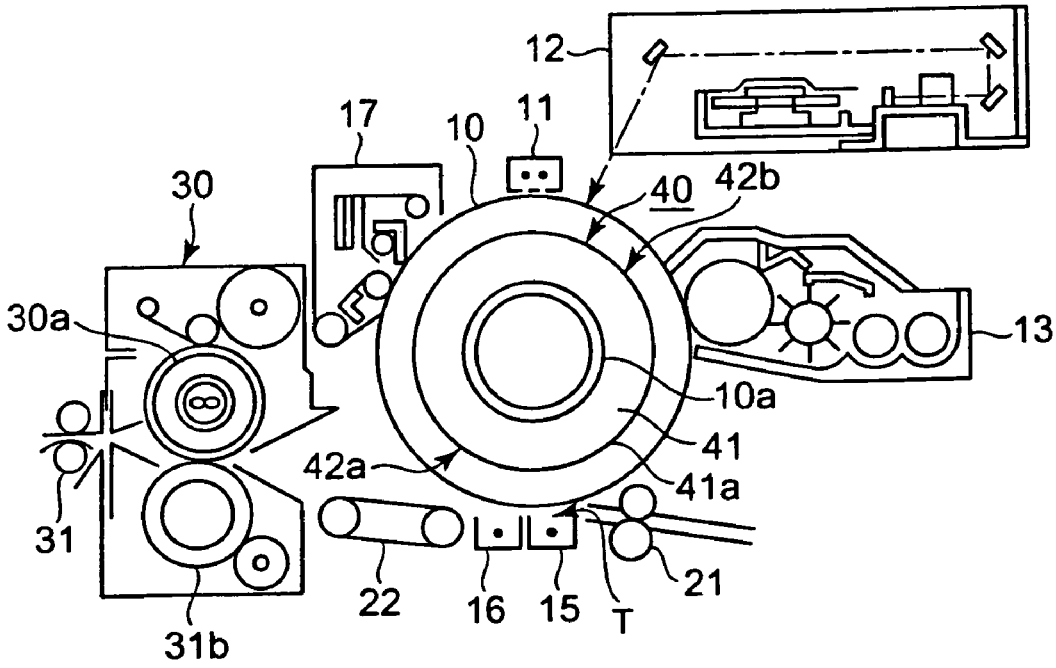
FIG. 1 is a view showing a sectional arrangement of an image printing apparatus according to the present invention.

The present invention is not therefore limited to the image printing apparatus shown in FIG. 1, and is widely applied to image printing apparatuses which form toner images on image carriers by the electrophotographic scheme.

A charger 11, image exposure device 12, developing device 13, transfer device 15, separator 16, and cleaning device 17 are arranged around a rotating photosensitive drum 10 which performs image printing operation. In performing image printing operation, the surface of the photosensitive drum 10 is uniformly charged by the charger 11 using a scorotron charger or the like. The image exposure device 12 then modulates a laser beam on the basis of an image information signal and applies the light on the uniformly charged photosensitive drum, thereby forming an electrostatic latent image. The electrostatic latent image is developed by the developing device 13 to which a developing bias is applied. As a consequence, a toner image is formed on the photosensitive drum 10.

An image recording sheet (transfer sheet) separated/conveyed from a paper feed tray is temporarily stopped at registration rollers 21. This sheet is then conveyed in synchronism with the toner image formed on the photosensitive drum 10 and reaches a transfer region T.

The transfer device 15 transfers the toner image from the photosensitive drum 10 onto the transfer sheet by applying a bias having a polarity opposite to that of toner from behind the transfer sheet in the transfer region T. The separator 16 separates the transfer sheet carrying the transferred toner image from the photosensitive drum 10 by applying an AC bias and DC bias upon superimposing the biases.

The toner left on the photosensitive drum 10 after the transfer sheet is separated is removed from the photosensitive surface by the cleaning device 17.

The transfer sheet onto which the toner image is transferred in the transfer region T is conveyed on a convey belt 22 and is clamped/conveyed by a fixing device 30 comprising a heating roller 30*a* and pressure roller 31*b*. During this conveyance, the toner image is fixed on the transfer sheet by being heated and pressurized. The image-fixed transfer sheet is delivered outside the apparatus by delivery rollers 31.

A known photosensitive drum driving control method which has been conventionally proposed will be described next.

Figure 2:
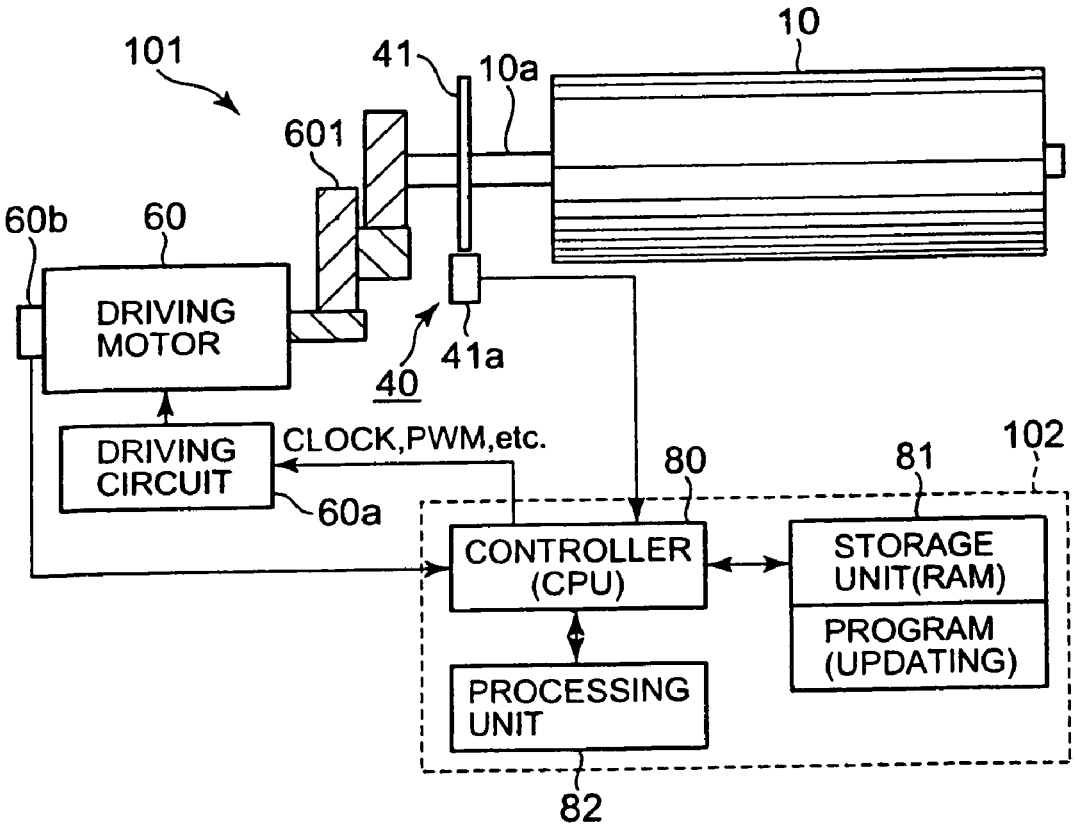
FIG. 2 is a block diagram showing a driving unit and control unit for a photosensitive drum.

FIG. 2 is a block diagram showing a driving unit 101 and control unit 102 for the photosensitive drum.

Figure 3:
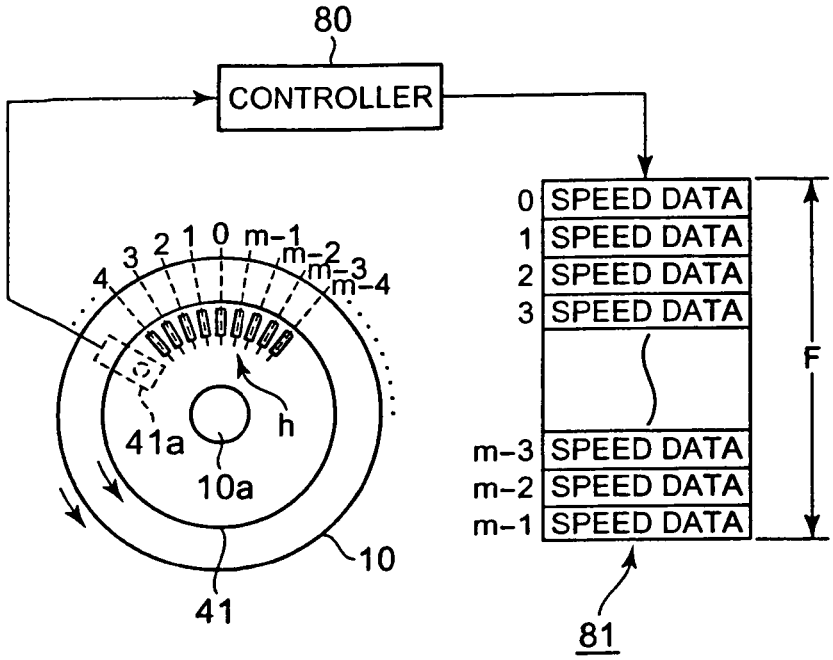
FIG. 3 is a view for explaining the correspondence between a rotating disk (drum position) and a storage unit in rotational speed detection.

FIG. 3 is a view for explaining the correspondence between a rotating disk (drum position) and a storage unit (memory) 81 in rotational speed detection.

An encoder 40 as a detecting unit which detects a rotational speed (angular speed) is mounted on a drum shaft 10*a* of the photosensitive drum 10. The encoder 40 is provided with a rotating disk 41 mounted on the drum shaft 10*a*. On an outer peripheral portion of the rotating disk 41, m slits h (see FIG. 3) are arranged at predetermined intervals in the form of a ring. That is, the photosensitive drum 10 is segmented according to the read resolution of the encoder 40. A speed detecting unit 41*a* (see FIGS. 2 and 3) which detects light through the slits h is placed on the rotating disk 41. Therefore, m pulses are detected per rotation of the photosensitive drum 10. Reference symbol F denotes one rotation cycle of the photosensitive drum.

Referring to FIGS. 2 and 3, the detection value detected by the speed detecting unit 41*a* of the encoder 40 with respect to the rotating photosensitive drum 10 in a steady state is input to a controller (CPU) 80 as a control unit and is updated and stored in real time, as the data of the rotation speed detected during one rotation (cycle) of the photosensitive drum 10, in a storage unit (RAM) 81 as a memory. According to the conventional technique, therefore, a rotational speed at the current drum position at the same position in a rotation cycle and "its near position" is stored in the storage unit 81 upon updating of the rotational speed at the past drum position in n rotations (e.g., one rotation) before the current drum position. Consecutively, a rotational speed of the photosensitive dram 10 is controlled on the basis of a rotational speed difference between the detected rotational speed and a target rotational speed (a rotational speed of the photosensitive dram which is set as a control target). In this case, "its near position" indicates a region based on the consideration of a response delay.

The controller 80 causes a processing unit 82 to perform computation processing such as a comparison between the target rotational speed and a rotational speed at the drum position in one rotation before the current rotation or a rotational speed at its near position from the storage unit (RAM) 81, etc., by reading out those rotational speeds, and outputs a command value for rotations at a uniform angular speed to a driving circuit 60*a* used for a driving motor 60 (a DC brushless motor in this embodiment) driving the photosensitive drum 10 on the basis of the computation processing result.

An encoder 60*b* is also placed on the rotating shaft of the driving motor 60. This is because it is necessary to perform rotational speed control in the same manner as for the DC brushless motor which tends to cause a load variation.

A control unit which controls the above rotating/driving process will be described next with reference to FIGS. 2 and 4.

Figure 4:
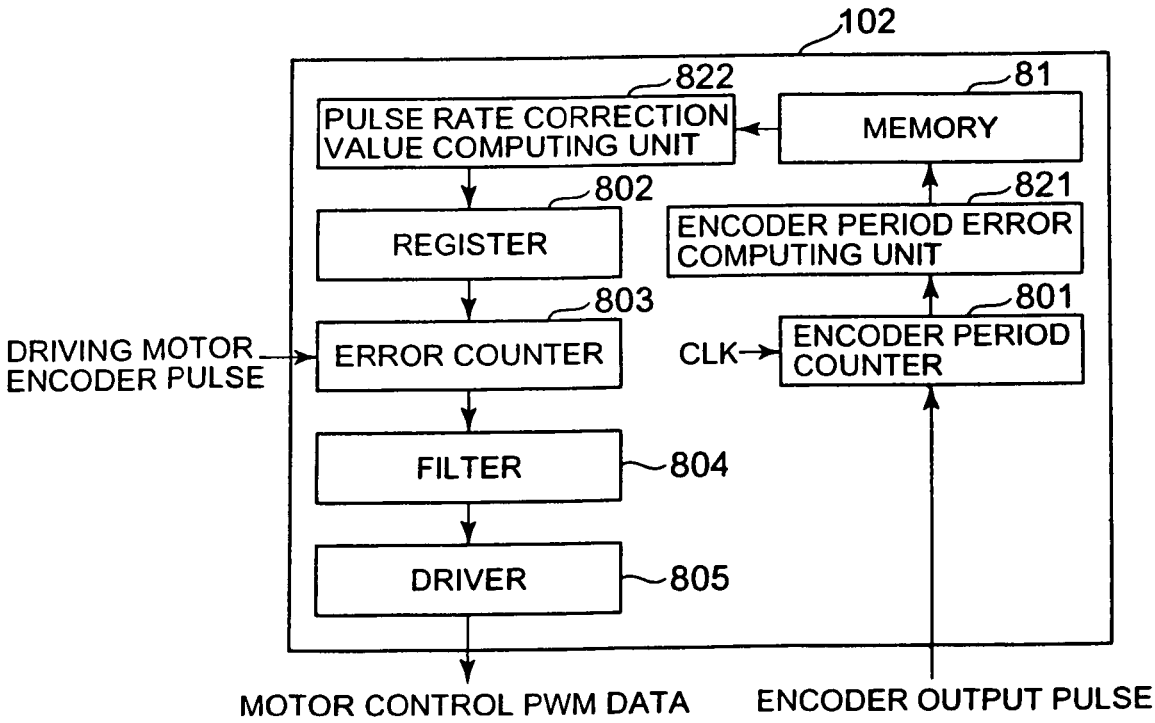
FIG. 4 is a block diagram showing a circuit arrangement associated with the control unit.

FIG. 4 is a block diagram showing a circuit arrangement associated with the control unit.

Referring to FIGS. 2 and 4, an output pulse from the encoder 40 is output to an encoder period counter 801 of the controller 80. The rotating disk 41 described above has the m slits h and outputs m pulses from the encoder 40 per rotation of the photosensitive drum 10. The encoder period counter 801 counts clocks CLK having a predetermined frequency on the basis of encoder output pulses, and outputs each encoder pulse period as a clock count value for each pulse, and further stores the encoder pulse period as a rotational speed dada in the storage unit 81 for each pulse. A pulse rate correction value computing unit 822 of the processing unit 82 calculates a correction value which cancels the rotation error of the photosensitive drum 10 by the comparison between rotation error data concerning encoder pulse period data in a predetermined interval centered on the same rotational position in n rotations before the current position of the photosensitive drum 10, which is stored in the storage unit 81, and the target rotational speed (a rotational speed of the photosensitive drum which is set as a control target). The pulse rate correction value computing unit 822 obtains correction data by filtering non-periodic high-frequency components due to the pitch or the like of a reduction gear 601 throughout the predetermined interval, and outputs the data to a register 802. An error counter 803 compares the correction data stored in the register 802 with the period of the pulse from the encoder 60*b* which is based on the driving motor 60, and outputs data indicating the error between them to a filter 804. The filter 804 performs gain adjustment or phase compensation processing for the output data from the error counter 803, and outputs the resultant data to a driver 805 of the driving motor 60. The driver 805 converts the error data output from the filter 804 into a PWM (Pulse Duration Modulation) signal, and outputs it to the driving motor 60.

Note that the above prior art uses a DC brushless motor. However, a stepping motor can also be used in place of the DC brushless motor.

According to the conventionally proposed technique, as described above, when an uncontrollable accidental variation has occurred, the speed detecting unit detects this accidental variation. This variation is stored in the above storage unit 81, thus affecting subsequent rotation control.

As shown in FIGS. 5A to 5D, control for correcting the accidental variation is activated in the next rotation cycle.

FIGS. 5A to 5D are views showing an example of how an accidental variation which has occurred in the latest (first) rotation influences each subsequent cycle when the conventional control method is used.

Referring to each of FIGS. 5A to 5D in which the dotted line indicates the rotational speed as a control target (the target rotational speed) without rotation variation, the rotational speed control of the present invention is usually performed by comparing the target rotational speed with a rotational speed in n rotations before a current rotational speed.

Figure 5A:
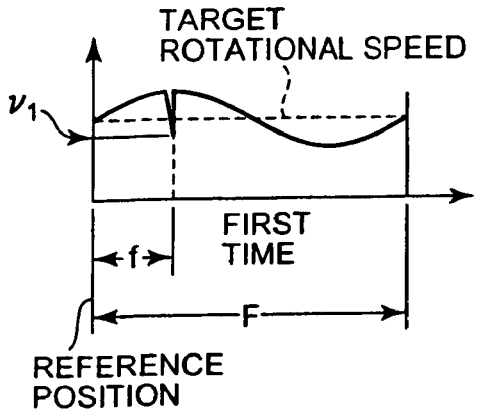
FIGS. 5A to 5D are views showing an example of how an accidental variation which has occurred in the latest (first) rotation influences each of subsequent cycles (second to fourth cycles) when a conventional control method is used.
Figure 5B:
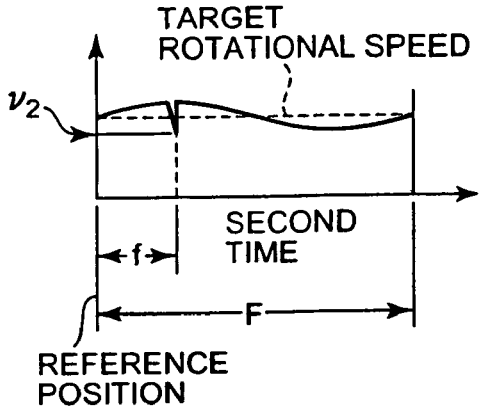
Figure 5C:
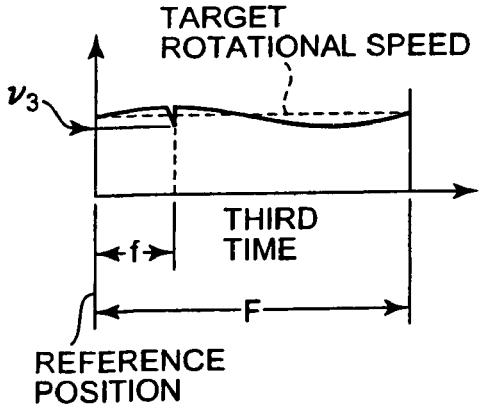
Figure 5D:
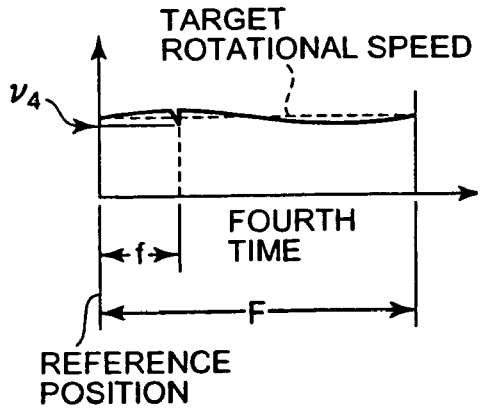

Referring to FIGS. 2 and 5A, when a rotational speed v1 of the latest rotation variation is detected at a rotational position f from the reference position of the rotating drum, this rotational speed data is stored in the storage unit (RAM) 81. In the second cycle, since the data in the first cycle is referred to, even when no accidental variation actually occurs at the rotational position f, the rotational speed control is activated to suppress the rotational speed v1, and therefore a rotational speed v2 shown in FIG. 5B is left as an abnormal value. As a result, as shown in FIGS. 5C and 5D, this affects the third and fourth cycles. Note that at positions other than the rotational position f, the rotational speed difference is reduced by normal control.

The present invention has been proposed to avoid the above problems. That is, the image printing apparatus of this embodiment has a control unit which controls the rotational speed of an image carrier, a detecting unit which detects the rotational speed, the storage unit 81 which stores rotational speeds up to n past rotations of the imager carrier, and a determining unit which compares the latest rotational speed with a rotational speed in a past rotation cycle n rotation cycles before a current rotation cycle at a predetermined interval which includes the same position in rotation cycles and its near position, and determines whether a rotational speed difference between both these two rotational speeds is more than a predetermined reference value. The control unit controls the rotational speed of the image carrier by using rotational speed data at a predetermined interval including the same rotational position in the n past rotation cycle before the current rotation cycle. The control unit further controls the rotational speed in the next rotation cycle in accordance with the determination result obtained by the determining unit.

In other words, it is determined whether the rotational speed data contains any accidental rotation variation, and subsequent rotational speed control is performed on the basis of the comparison between the latest rotational speed and the rotational speed in a past rotation cycle n rotation cycles before a current rotation cycle. This makes it possible to perform accurate rotational speed control without letting an accidental rotation variation affect rotational speed control.

Note that the controller 80 includes a determining unit which compares the latest rotational speed with the rotational speed in the n past rotation cycle before the current rotation cycle at the same position in rotation cycles and its near position, and determines whether the rotational speed difference acquired by the aforesaid comparison is more than a predetermined reference value.

And n is an integer and n is larger than 1. The n may be determined by such as control condition etc.

In addition, the predetermined reference value (set threshold) is used for discriminating the accidental rotation variation and is set on the basis of load variation components suppressible (traceable) by a control mechanism. When the rotational speed difference between the latest rotational speed and the rotational speed in a past rotation cycle n rotation cycles before the current rotation cycle exceeds the predetermined reference value, it is determined that the accidental rotation variation is caused. On the contrary, when the rotational speed difference is within a range of the predetermined reference value, it becomes possible to perform a usual rotational speed control by the control mechanism.

Figure 6A:
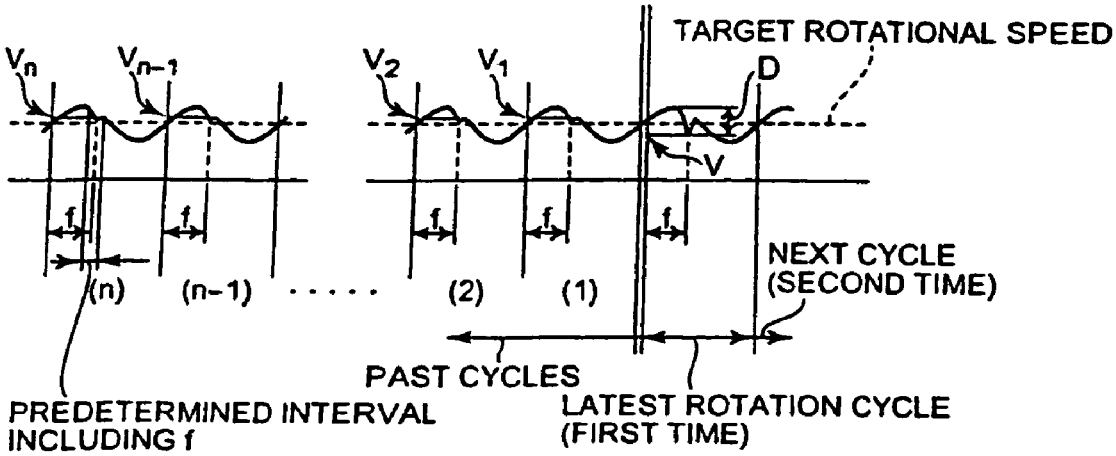
Figure 6B:
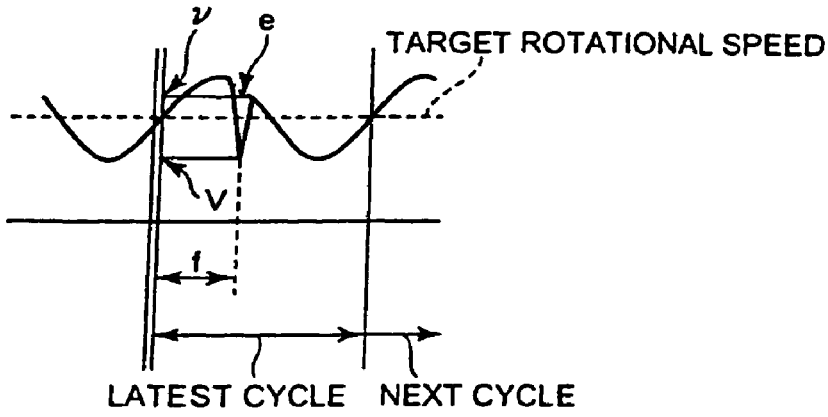

FIGS. 6A and 6B are views showing rotation variations in the latest and past rotation cycles.

According to the first embodiment, there is provided an image printing apparatus, in which when it is determined that the rotational speed difference between a rotational speed in n past rotation cycle before a current rotation cycle and the latest rotational speed is more than the predetermined reference value, the control unit calculates the average value of rotational speeds at a predetermined interval including the same rotational position in each past rotation cycle after the n past rotation of the image carrier, and controls the rotational speed in the next rotation cycle by using the average value.

According to the first embodiment, a rotational speed at a drum position in n rotations (n rotation cycles) before the current (latest) rotation (rotation cycle) or a rotational speed at its near position is stored in the storage unit 81. Subsequently, a rotation speed difference D between the stored rotational speed and a rotational speed in the current (latest) rotation cycle is acquired. When the rotation speed difference D is more than a predetermined reference value (set threshold), an average value (V1+V2 . . . Vn)/n of rotational speeds within n rotation cycles at the rotational positions f in the respective cycles is stored, as first time (latest cycle) data, in the storage unit 81, by using a rotational speed at the drum position (rotational position f) in rotation cycles after past n rotations or the rotational speed Vn at its near position. And rotational speeds in the subsequent (second or subsequent) cycles are controlled by using the first time data as a reference data. Therefore, rotational speed differences are averaged, and more stable rotations can be realized, thereby ensuring an accurate image.

That is, an accurate rotational speed is obtained by not using rotational speed data with an accidental rotation variation as data for rotational speed control for the next rotation.

The pulse rate correction value computing unit 822 calculates the average value of n rotational speed differences by using the n rotational speed differences at the rotational positions f in past rotation cycles which are stored in the storage unit 81 in FIG. 2 as data, and outputs the calculated value to the register 802.

With the above rotational speed control, even when an accidental rotation variation occurs, the influence of the variation on the subsequent rotations can be suppressed. This makes it possible to ensure stable rotations of the image carrier and obtain an accurate image.

In the latest (first time) rotation, when the rotational speed difference between the rotational speed in n past rotation cycle before a current rotation cycle and the current rotation cycle is less than a predetermined reference value, the rotational speed data in this case is used for the next (second) data as rotational speed case in a predetermined interval including the same rotational position f, thereby performing rotational speed control in the next cycle.

Figure 7A:
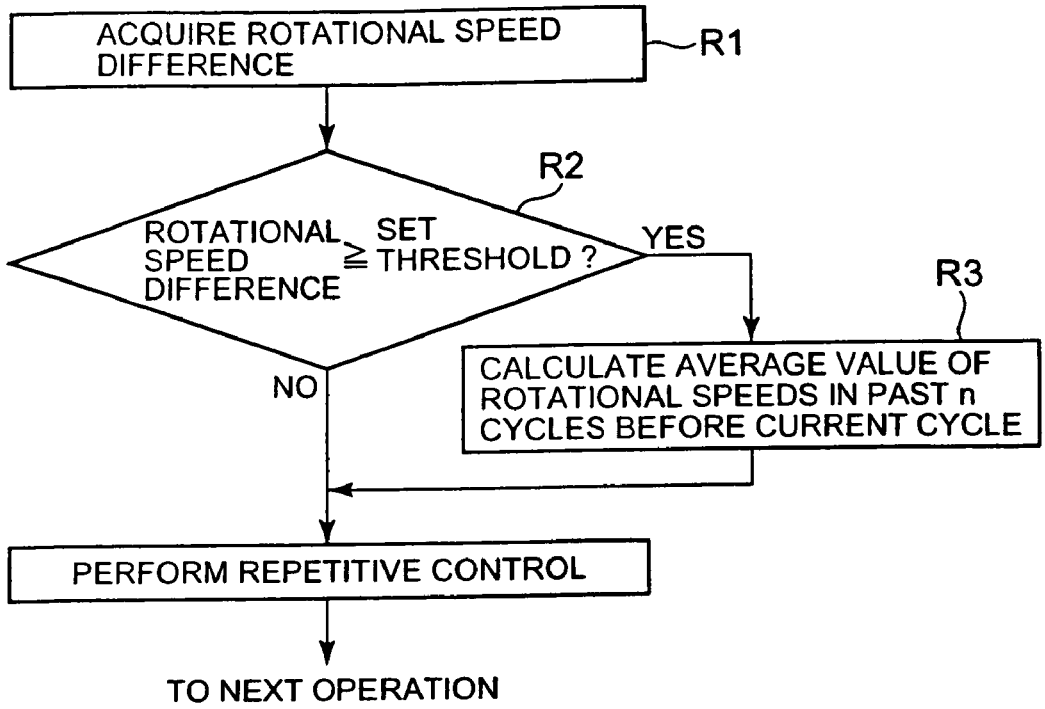
FIGS. 7A to 7D are flowcharts each showing operation associated with each embodiment of the present invention.
Figure 7B:
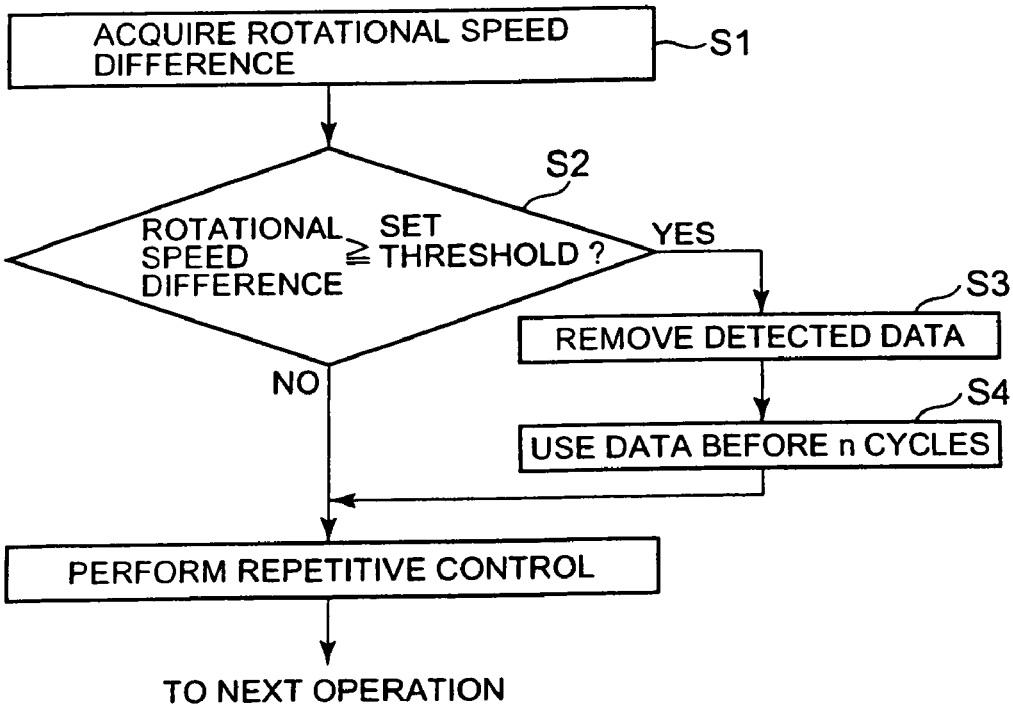

FIGS. 7A and 7B show control flows associated with the respective embodiments of the present invention.

A control process in the first embodiment will be described with reference to FIG. 7A.

In step R1, the current (latest) rotational speed is compared with a rotational speed at the same position (rotational position f) in the rotation cycle n cycle before the current cycle to acquire a rotational speed difference. When it is determined in step R2 that this rotational speed difference is larger than a predetermined reference value (set threshold), the average value of rotational speed differences at the same positions in the current rotation cycle and the past rotation cycle n rotation cycles before the current rotation cycle and at its near position is calculated and stored as data in step R3. Subsequently, repetitive rotational speed control (feedforward control) is performed, and the flow advances to the next operation. When it is determined in step R2 that the rotational speed difference is smaller than the predetermined reference value (set threshold), the flow advances to the next operation through normal feedforward control.

According to the second embodiment, there is provided an image printing apparatus, in which when a determining unit determines that the rotational speed difference between a rotational speed in a past rotation cycle n rotation cycles before a current rotation cycle and the latest rotational speed is larger than a predetermined reference value, a control unit controls the rotational speed in the subsequent cycle by using rotational speed data in the past n cycles before the current cycle while neglecting the latest rotational speed detected by a detecting unit.

According to the second embodiment, a rotational speed difference between a rotational speed at a rotational position f which is detected in the current (latest) rotation and a rotational speed detected in the n past rotation cycles before the current rotation cycle is acquired. Successively, when the rotational speed difference is more than a predetermined reference value, the data of the latest detected rotational speed is not stored in the storage unit 81 (the latest data is neglected), and a rotational speed at the same position in the past rotation cycle n rotation cycles before the current rotation cycle is stored as data, and this data is used for a rotational speed control in the subsequent rotation cycle.

Referring to FIG. 6A, in place of a rotation speed V at the latest rotational position f, a rotational speed Vn at the rotational position f in the past rotation cycle n rotation cycles before the current rotation cycle is stored, thereby controlling a rotational speed in the subsequent rotation cycle.

A control process in the second embodiment will be described with reference to FIG. 7B.

Referring to FIG. 7B, in step S1, the current (latest) rotational speed is compared with a rotational speed at the same position (rotational position f) in the rotation cycle n rotation cycles before the current rotation cycle to acquire a rotational speed difference. When it is determined in step S2 that the rotational speed difference is larger than a predetermined reference value (set threshold), the latest detected data is regarded as an accidental variation and is not stored (is excluded) in step S3. In step S4, reference data in the past rotation cycle n rotation cycles before the current rotation cycle is stored in the storage unit 81, and the flow advances to the subsequent operation through feedforward control. When it is determined in step S2 that the rotational speed difference is smaller than the predetermined reference value (set threshold), the flow advances to the next operation through normal feedforward control.

According to the third embodiment, there is provided an image printing apparatus in which when it is determined that the rotational speed difference between a rotational speed in a past rotation cycle n rotation cycles before a current rotation cycle and the latest rotational speed is larger than a predetermined reference value, a control unit changes a control computation coefficient for calculating the rotational speed of an image carrier in accordance with the rotational speed difference.

According to the third embodiment, the control coefficient is changed so as to make the rotational speed difference become less than a predetermined reference value at a rotational position f.

That is, in accordance with the rotational speed difference between the rotation speed V due to an accidental variation at the rotational position f and the rotational speed Vn in the past rotation cycle n rotation cycles before the current rotation cycle in FIG. 6B, a rotational speed of the image carrier is suppressed to a rotational speed v (see a dotted line e on the graph) by changing a control coefficient, and the rotational speed difference d suppressed at the latest rotational position f is stored as data, and this data is used for a rotational speed control in the subsequent rotation cycle.

A control process in the third embodiment will be described with reference to FIG. 7C.

Figure 7C:
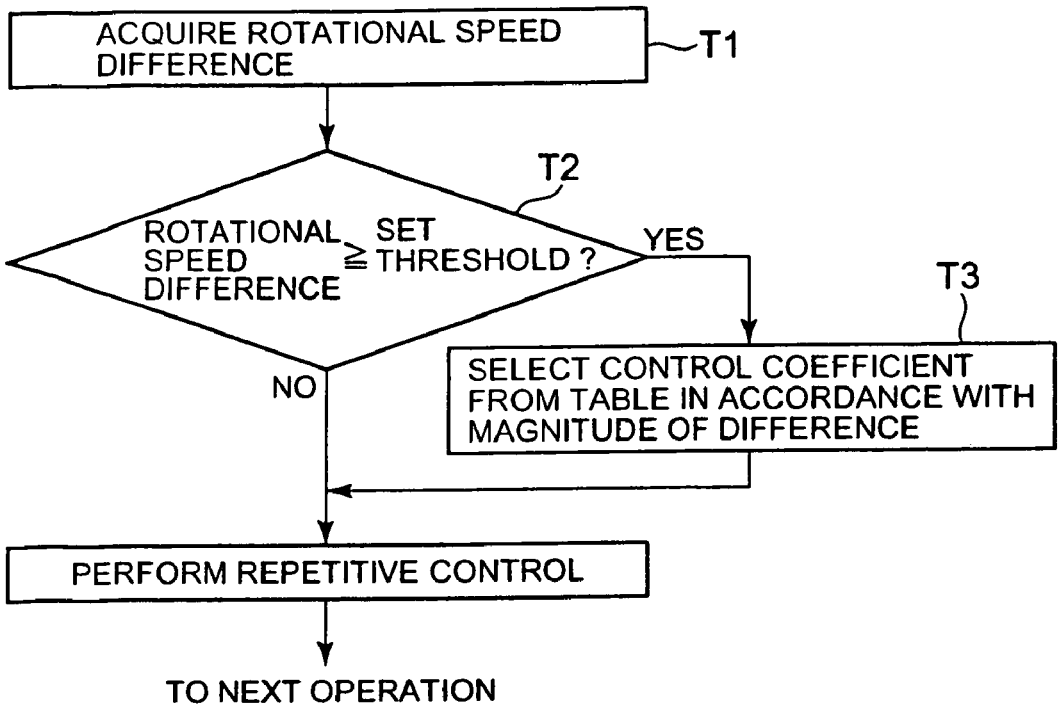

Referring to FIG. 7C, in step T1, the current (latest) rotational speed is compared with a rotational speed at the same position (rotational position f) in the rotation cycle n rotation cycles before the current rotation cycle to acquire a rotational speed difference. This rotational speed difference is compared with the predetermined reference value (set threshold) in step T2. When the rotational speed difference is larger than a predetermined reference value (set threshold), the latest detected data is regarded as an accidental variation in step T3. Further, a control coefficient is selected from a table (a table of coefficients which suppress detected rotational speeds to rotation speeds within a reference) in accordance with the magnitude of the rotational speed difference in step T3, thereby suppressing (changing) the rotational speed to a speed within the predetermined reference value range. The changed reference data is stored as the latest data, and the operation flow advances to the next operation through normal feedforward control. When it is determined in step T2 that the rotational speed difference is smaller than the predetermined reference value (set threshold), the flow advances to the next operation through normal feedforward control. Note that as processing for control coefficients, for example, gain adjustment, filter processing, or the like may be used at the rotational position f.

According to the fourth embodiment, there is provided an image printing apparatus which further includes a real time control unit which controls the rotational speed of the image carrier by feeding back the rotational speed of the image carrier in real time. When the rotational speed difference is larger than a predetermined reference value, the rotational speed of the image carrier is controlled in real time by only feedback control with using the real time control unit without performing repetitive rotational speed control.

According to the fourth embodiment, the rotational speed at the rotational position f which is detected from the current (latest) rotation is compared with the rotational speed detected in the rotation cycle n rotation cycles before the current rotation cycle. When this rotational speed difference is more than the predetermined reference value, the rotational speed of the image carrier is detected in real time, and the detected rotational speed is controlled by only feedback control without performing feedforward control. The operation flow then advances to the next operation.

Figure 8:
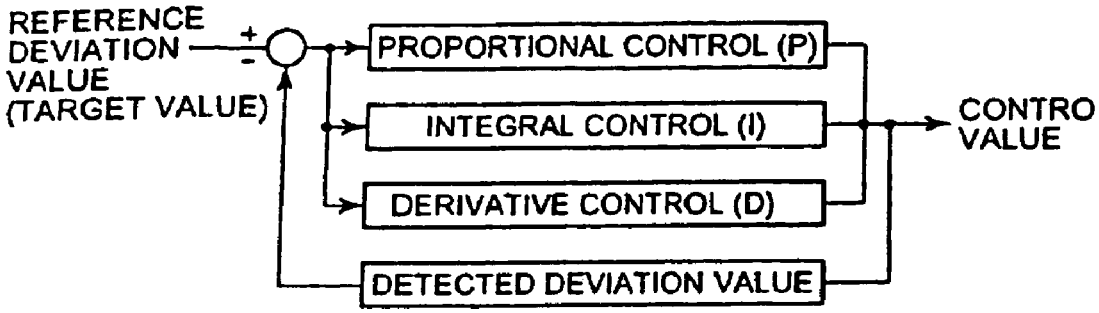
FIG. 8 is a block diagram showing a basic proportional-derivative-integral (PDI) control form.

For example, a rotational speed difference is controlled by a feedback control unit using a control form based on proportional-derivative-integral control which performs general rotational speed control like that shown in FIG. 8.

FIG. 8 is a block diagram showing a proportional-derivative-integral (PDI) control form.

Referring to FIG. 8, a detected deviation value (speed difference) is fed back, and proportional control (P) is performed to multiply the deviation value by a coefficient and output the resultant value. That is, a coefficient is derived from the characteristics of a system to bring the deviation value as close to a target value as possible. In derivative control (D), the derivative value of the detected deviation is multiplied by a coefficient, and the resultant value is output. That is, this control has both the effect of an input follow-up characteristic which excludes a steady deviation and the effect of disturbance suppression. In integral control (I), the integral value of the detected deviation is multiplied by a coefficient, and the resultant value is output. That is, this control immediately suppresses a disturbance by giving a large change based on the coefficient calculated from system characteristics to a small change in variation.

A control process in the fourth embodiment will be described with reference to FIG. 7D.

Figure 7D:
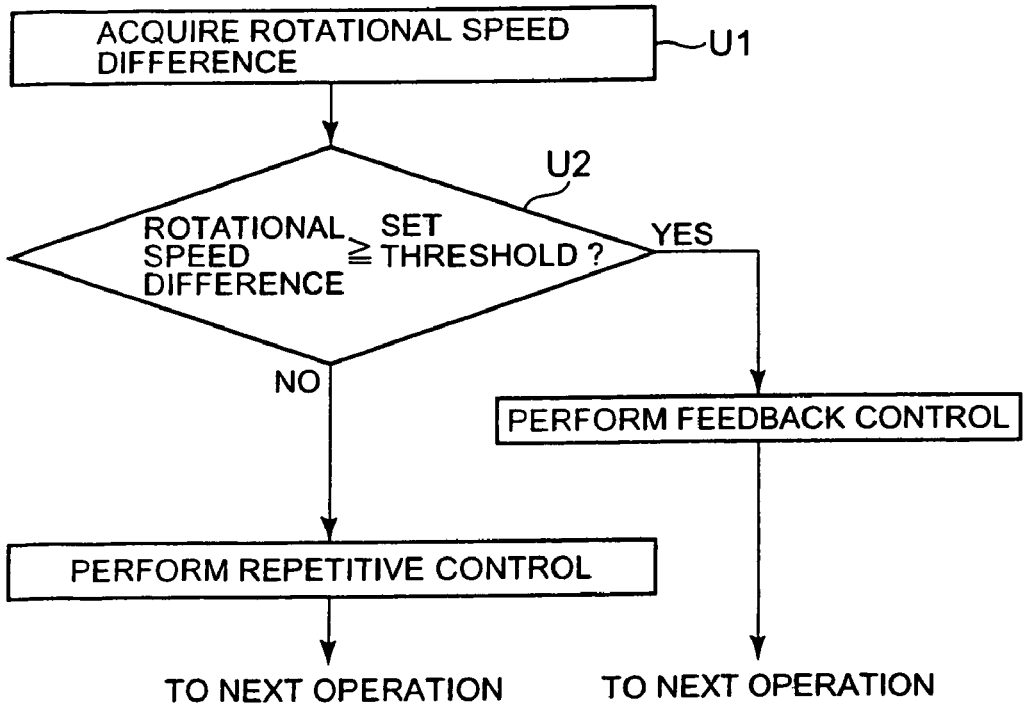

Referring to FIG. 7D, in step U1, the current (latest) rotational speed is compared with the rotational speed at the same position (rotational position f) in the rotation cycle n cycles before the current cycle to acquire a rotational speed difference. In step U2, the acquired rotational speed difference is compared with the predetermined reference value (set threshold), and with the result that, when the rotational speed difference is larger than the predetermined reference value (set threshold), the detected latest data is regarded as an accidental variation, and the process is operated by only the above feedback control without repetitive rotational speed control. The operation flow then advances to the subsequent operation. On the contrary, when it is determined in step U2 that the rotational speed difference is smaller than the predetermined reference value (set threshold), the flow advances to the next operation through normal feedforward control.

Controlling the rotational speed of the photosensitive drum by the methods of the four embodiments described above makes it possible to ensure stable rotations and obtain an accurate image.

By applying the above rotational speed control method for the photosensitive drum to the image printing apparatus shown in FIG. 1, accurate, proper uniform angular speed control is performed, and a high-quality image without any positional shift can be obtained. When the rotational speed control method of the present invention is applied to the tandem type color image printing apparatus shown in FIG. 9, the effect of this method becomes more conspicuous.

Figure 9:
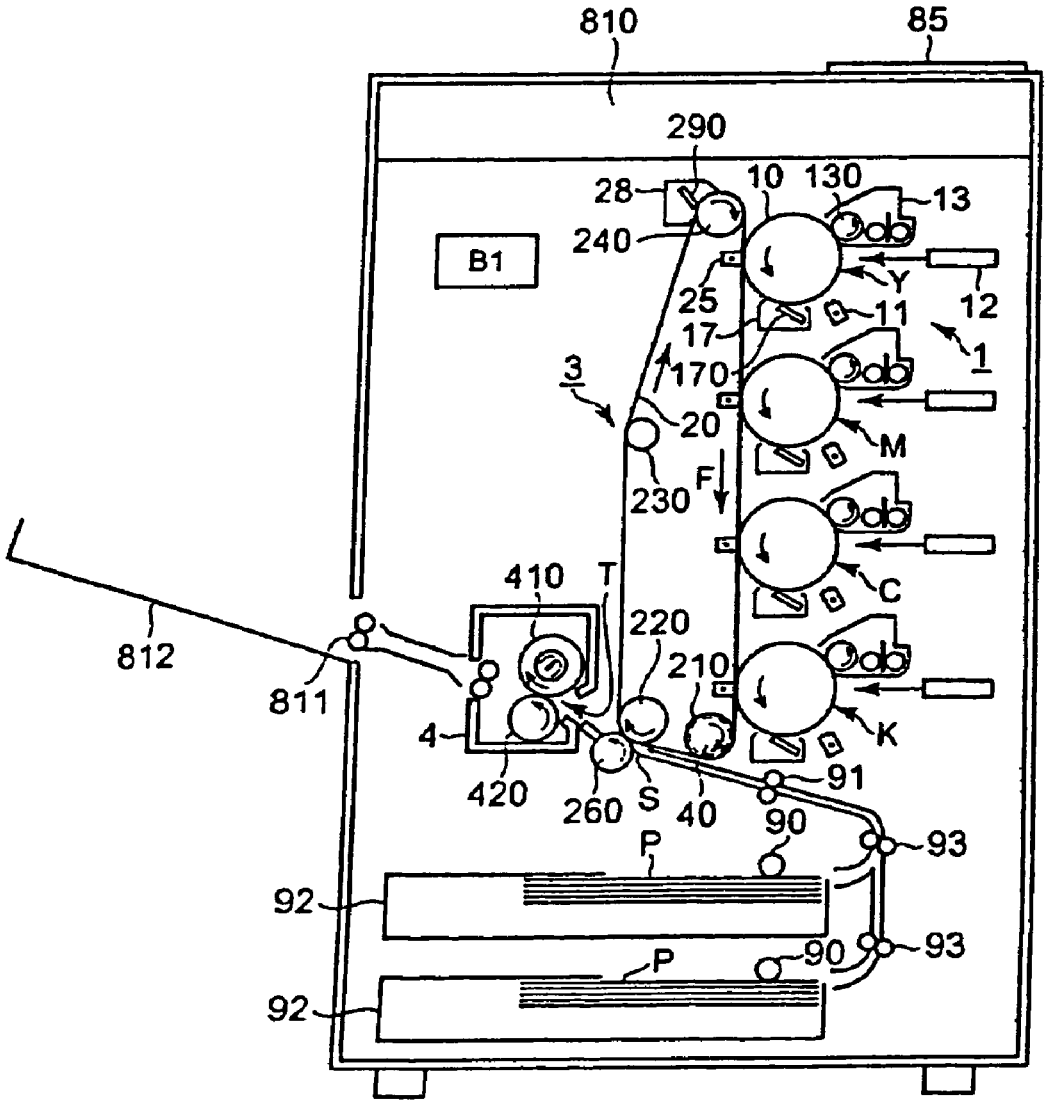
FIG. 9 is a view showing a sectional arrangement of a tandem color image printing apparatus.

FIG. 9 is a view showing a sectional arrangement of the tandem type color image printing apparatus.

The same reference numerals as in FIG. 1 denote units having the same functions in FIG. 9.

Reference numeral 10 denotes a photosensitive member; 11, a scorotron charger as a charging unit; 12, a writing device as an image writing unit; 13, a developing device as a developing unit; 17, a cleaning device for cleaning the surface of the photosensitive member 10; 170, a cleaning blade; 130, a developing sleeve; and 20, an intermediate transfer belt. An image printing unit 1 comprises the photosensitive member 10, scorotron charger 11, developing device 13, cleaning device 17, and the like. Since the image printing units 1 of the respective colors have the same mechanical arrangements, reference numerals are assigned to only the arrangement of the Y (yellow) system, and reference numerals for the constituent elements for M (magenta), C (cyan), and K (black) are omitted in FIG. 1.

The image printing units 1 of the respective colors are arranged in order of Y, M, C, and K in the traveling direction of the intermediate transfer belt 20. Each photosensitive member 10 comes into contact with the stretched surface of the intermediate transfer belt 20, and rotates in the same direction as the traveling direction of the intermediate transfer belt 20 and at the same linear speed as that of the belt at the contact point.

The intermediate transfer belt 20 is stretched over a driving roller 210, ground roller 220, tension roller 230, discharge roller 270, and driven roller 240. These rollers, the intermediate transfer belt 20, a transfer device 25, a cleaning device 28, and the like constitute a belt unit 3.

The intermediate transfer belt 20 is made to travel by the rotations of the driving roller 210 driven by a driving motor (not shown).

The photosensitive member 10 is obtained by forming a conductive layer and a photosensitive layer such as an a-Si layer or organic photoconductor (OPC) on the outer surface of a cylindrical metal base member made of, for example, an aluminum material. The photosensitive member 10 rotates in the counterclockwise direction indicated by the arrow in FIG. 9 while the conductive layer is grounded.

An electrical signal corresponding to image data from a reading device 810 is converted into an optical signal by an image printing laser. This light is then applied from the writing device 12 onto the photosensitive member 10.

The developing device 13 has the cylindrical developing sleeve 130 made of nonmagnetic stainless steel or an aluminum material, which rotates in a direction opposite to the rotating direction of the photosensitive member 10 at the nearest position while keeping a predetermined distance from the surface of the photosensitive member 10.

Reference numeral 25 denotes a transfer device, to which a DC voltage having a polarity opposite to that of toner is applied and which has a function of transferring a toner image formed on the photosensitive member 10 onto the intermediate transfer belt 20.

Reference numeral 260 denotes a transfer roller which can be brought into contact with and separated from the ground roller 220 and re-transfers a toner image formed on the intermediate transfer belt 20 onto a transfer medium P.

Reference numeral 28 denotes a cleaning device, which is placed to face the driven roller 240 through the intermediate transfer belt 20. After the toner image is transferred onto the transfer medium P, the discharge roller 270, to which an AC voltage on which a DC voltage having the same or opposite polarity to that of toner is superimposed is applied, weakens the charge of residual toner, and a cleaning blade 290 cleans the toner left on the surface of the belt.

Reference numeral 90 denotes feed rollers; 91, timing rollers; 92, a paper cassette; and 93, convey rollers.

Reference numeral 4 denotes a fixing device, which clamps and pressurizes a transfer medium, onto which a toner image on the intermediate transfer belt 20 is transferred, at a nip portion T formed between two rotating members, i.e., a heating roller 410 and pressure roller 420, at least one of which has a heat source, thereby fixing the toner image. Reference numeral 811 represent delivery rollers, which deliver a fixed transfer medium to a delivery tray 812. In addition, reference numeral 85 denotes an operation panel, which is controlled by the control unit for the respective driving units, an image printing process, a fixing temperature, and the like.

In the tandem type image printing apparatus having the above arrangement, mounting the encoders 40 on the driving roller 210 for driving the intermediate transfer belt 20 as an image carrier and on the rotating shaft of a driven roller 220 of the intermediate transfer belt 20 and using the above control unit make it possible to not only control rotation/driving of the photosensitive member 10 but also control rotation (travel) of the intermediate transfer belt 20 with high accuracy. This allows the apparatus to ensure stable rotation and obtain an accurate image without being influenced by an accidental speed variation.

What is claimed is:

1. An image printing apparatus, comprising:

a control unit which controls a rotational speed of an image carrier;

a detecting unit which detects data of the rotational speed;

a storage unit which stores the rotational speeds up to n past rotation cycles of the image carrier;

a determining unit which determines whether a rotational speed difference between a latest rotational speed in a current rotation cycle and a rotational speed in the n past rotation cycle before the current rotation cycle at a predetermined interval, which includes a same rotational position in respective rotation cycles and its near position, is more than a predetermined reference value; and a real time control unit which controls the rotational speed of the image carrier by feeding back the rotational speed of the image carrier in real time, wherein the control unit controls the rotational speed of the image carrier by using the data of the rotational speeds at the predetermined interval including the same rotational position in one or n past rotation cycles before the current rotation cycle, and further the control unit controls a rotational speed in a subsequent rotation cycle next to the current rotation cycle in accordance with a determination result obtained by the determining unit, and wherein when the determining unit determines that the rotational speed difference is more than the predetermined reference value, the control unit performs a rotational speed control by making use of a feedback control by the real time control unit without performing repetitive rotational speed control, which controls the rotational speed of the image carrier by using the data of the rotational speeds at the predetermined interval including the same rotational position in one or n past rotation cycles before the current rotation cycle.

2. The apparatus according to claim 1, wherein the real time control unit performs the repetitive rotational speed control after the feedback control.

3. The apparatus according to claim 1, wherein the detecting unit detects each rotational speed corresponding to each segment of the image carrier, which is obtained by segmenting one rotation into m equal segments, and the detected rotational speed is stored in the storage unit.

* * * * *